US006375512B1

(12) United States Patent
Zito et al.

(10) Patent No.: US 6,375,512 B1
(45) Date of Patent: Apr. 23, 2002

(54) PLATED PLASTIC CONNECTION SYSTEM AND METHOD OF MAKING

(75) Inventors: Donald J. Zito, Fox River Grove; Tomasz L. Klosowiak, Glenview; Nick Hopman, Lake Zurich, all of IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/651,153

(22) Filed: Aug. 30, 2000

Related U.S. Application Data

(63) Continuation of application No. 09/410,701, filed on Oct. 1, 1999, now Pat. No. 6,176,744.

(51) Int. Cl.[7] ..... H01R 24/00

(52) U.S. Cl. ..... 439/660; 439/886; 439/936; 439/931; 439/736; 439/76.1

(58) Field of Search ..... 439/886, 76.1, 439/83, 660, 936, 931, 722, 736, 876, 82

(56) References Cited

U.S. PATENT DOCUMENTS 4,969,842 A * 11/1990 Davis ..... 439/886
4,976,634 A * 12/1990 Green et al. ..... 439/936
5,409,403 A * 4/1995 Falossi et al. ..... 439/25
5,554,036 A * 9/1996 Shirai et al. ..... 439/660
5,626,483 A * 5/1997 Naitoh ..... 439/83
5,743,764 A * 4/1998 Czeschka et al. ..... 439/931
5,762,525 A * 6/1998 Candeloro ..... 439/660
5,779,505 A * 7/1998 Yagi et al. ..... 439/660
5,795,194 A * 8/1998 Hahn ..... 439/660
5,836,774 A * 11/1998 Tan et al. ..... 439/76.1
5,873,752 A * 2/1999 Baskin et al. ..... 439/936

* cited by examiner

*Primary Examiner*—Tho D. Ta
(74) *Attorney, Agent, or Firm*—Gary J. Cunningham; John J. King; Steven A. May

(57) ABSTRACT

The invention relates, in general, to electrical connector assemblies, and more particularly to plastic electrical connectors that employ metal plated plastic contacts. According to an aspect of the invention, an electrical connector is provided comprising a plastic shell having an open cavity that defines an internal surface, and an electrical connector contact that comprises a metal coated area of the internal surface.

3 Claims, 4 Drawing Sheets

PLATED PLASTIC CONNECTION SYSTEM AND METHOD OF MAKING

CROSS-REFERENCE TO RELATED APPLICATION

This application is based on prior U.S. Patent Application No. 09/410,701, filed Oct. 1, 1999, U.S. Pat. No. 6,176,744 and priority thereto is hereby claimed.

FIELD OF THE INVENTION

The invention relates, in general, to electrical connector assemblies, and more particularly to plastic electrical connectors that employ metal plated plastic contacts.

BACKGROUND OF THE INVENTION

In general, plastics have been implemented in a variety of ways to reduce the cost and weight of various structures. Electrical connector systems are very well suited for the use of plastic due to its natural electrical insulative qualities and the ease with which it may be molded into a variety of shapes. The ability to mold plastic with preformed molds makes it a very desirable material for mass production.

Prior electrical connectors commonly employ plastic to form the outer insulative shell. Metal contacts, typically in the form of pins, sleeves, or leaf-like springs, are inserted into holes that are molded or otherwise formed in the plastic shell. External electrical conductors, such as wires or circuit-board contacts, are crimped or soldered to the metal contacts. In other types of connectors, some parallel port computer connectors for example, stitched or insert molded connector pins are provided on the sides of the male portion of a plastic connector housing that absorbs forces to the pins. Although widely used, these prior metal contacts fail to exploit the benefits of using plastic to form the metal contacts in addition to the shell. Doing so promises to produce a lower cost connector more suitable for mass production.

According to a certain prior art connector, the contacts are formed from plastic in the shape of pins, very similar to its metal counterpart. The pins are relatively slender in length compared to diameter and are plated with a metal in order to provide an electrically conductive surface. While certainly safe and effective, contacts formed in such manner are susceptible to damage and may break when assembling the connector to a mating connector. As of yet, connectors made in such manner are not widely accepted or used by the industry.

Therefore, the problem addressed by the invention is to provide a plastic connector having a plated plastic contact that is resistant to damage, and to provide a facilitated manufacturing process therefor.

DETAILED DESCRIPTION OF PREFERRED EMBODIMENTS

Figure 1:
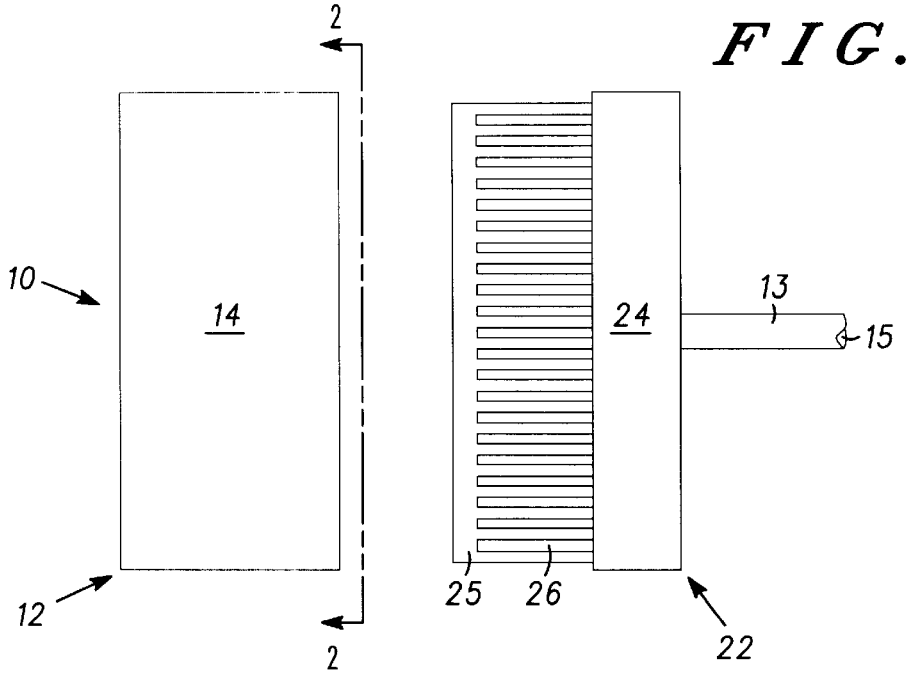
FIG. 1 presents a top plan view of a disassembled electrical connector assembly that employs an electrical connector according to an aspect of the invention.

Various aspects of the invention are presented in FIGS. 1–20, which are not drawn to scale, and wherein like components in the numerous views are numbered alike. Referring now specifically to FIG. 1, a plastic electrical connector assembly 10 is presented according an aspect of the invention. The connector assembly 10 comprises an electrical connector 12 having a plastic shell 14, and a matched electrical connector 22 comprising a matched plastic shell 24 that cooperates with and is received within the plastic shell 14. The matched electrical connector 22 comprises a blade portion 25 having an array of metal spring contacts 26 of standard configuration known in the art. A cable 13 may be connected to the matched electrical connector 22 having a plurality of conductors 15 electrically connected to the metal spring contacts 26.

Figure 2:
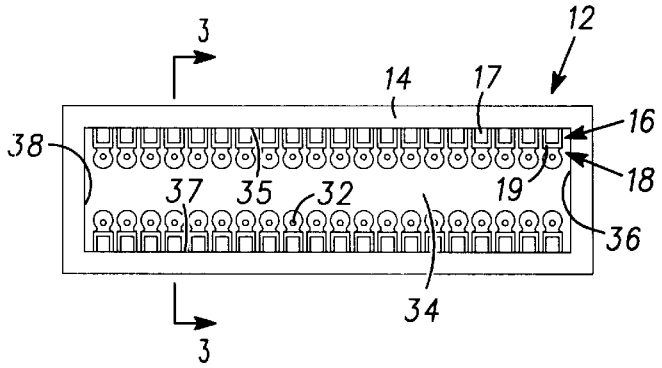
FIG. 2 presents a cross-sectional view taken along line 2—2 of FIG. 1.
Figure 3:
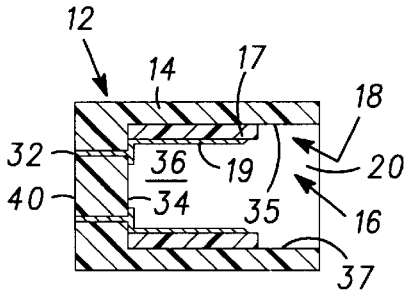
FIG. 3 presents a cross-sectional view taken along line 3—3 of FIG. 2.

Referring now to FIGS. 2 and 3, a cross-sectional view of the electrical connector 12 is taken along line 2—2 of FIG. 1, and a cross-sectional view of the first connector 12 taken along line 3—3 of FIG. 2, are presented, respectively, according to an aspect of the invention. The electrical connector 12 comprises the plastic shell 14 and has an internal cavity 30 that defines an internal surface 18 and an open end 20. An electrical connector contact 16 is provided comprising a metal coated area 19 of the internal surface 18. Typically, a plurality of such contacts are provided. According to an aspect of the invention, the internal surface 18 is a major structural surface of the plastic shell 14 that has supports 17 projecting therefrom for the electrical connector contact 16. According to a preferred embodiment, the plastic shell 14 comprises the open end 20 and the internal surface 18 is an internal wall (as shown) accessible through the open end 20 (FIG. 3), and each electrical connector contact 16 comprises a metal coated area 19 on the supports 17 of the internal wall. The electrical connector contact 16 according to the invention is far more resistant to damage than the metal plated plastic pin of the prior art since the internal wall or surface 18 structural supports the contact 16 along its length. Although described in relation to an example wherein the wall is internal, the invention may be employed equally well with a connector shell having an external wall, and the electrical connector contact 16 comprises a metal coated area of the external wall. Any such variations are considered to fall within the purview of the invention. Thus, a connector according to the invention comprises a plastic shell that defines a wall (internal or external), and an electrical connector contact that comprises a metal coated area of said wall.

A plurality of conductive vias 32 penetrate the internal wall or surface 18 and are electrically connected to a corresponding one of the electrical connector contacts 16. The internal cavity 30 comprises a floor 34, and the electrical connection may be made by extending the metal covered area 19 defined by the contact 16 onto the floor 34. The metal vias 32 may be comprised of a variety structures, including wire, metal ribbon, and other suitable structures for providing access to the contact 16 from outside, or external to, the shell 14. As described later in more detail, the vias 32 may include residual holes, and a sealant material may be employed to seal the hole.

Figure 4:
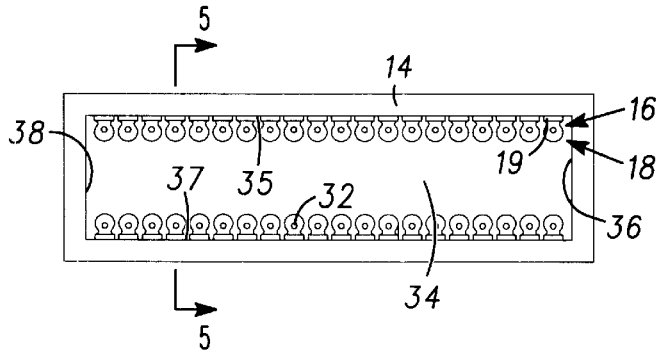
FIG. 4 presents a cross-sectional view of an alternative embodiment of the invention.
Figure 5:
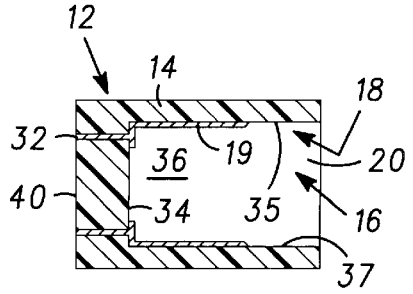
FIG. 5 presents a cross-sectional view taken along line 5—5 of FIG. 4.
Figure 6:
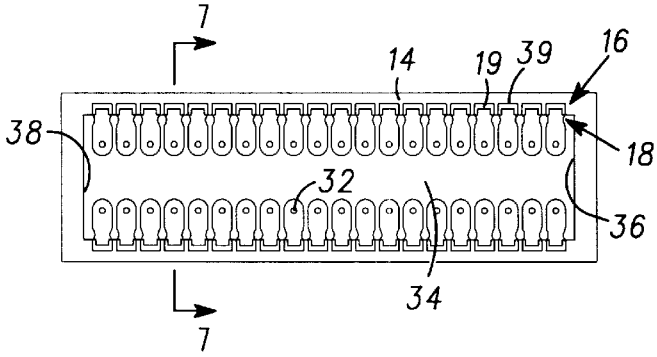
FIG. 6 presents a cross-sectional view of a further alternative embodiment of the invention.
Figure 7:
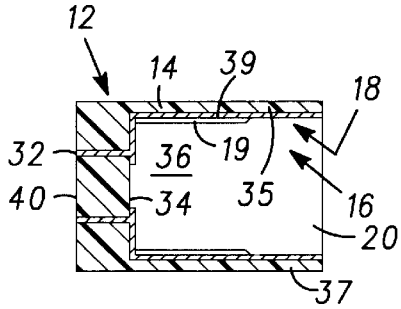
FIG. 7 presents a cross-sectional view taken along line 7—7 of FIG. 6.

In the example shown in FIGS. 2 and 3, the contact 16 is elevated above the internal wall or surface 18 by supports 17. Referring flow to FIGS. 4 and 5, an embodiment is presented wherein the electrical connector contact 16 is flush with the internal wall or surface 18, According to a further alternative, the electrical connector contact 16 may also be depressed below the internal wall or surface 18, as shown in FIGS. 6 and 7. As seen in FIGS. 6 and 7, indents 39 are provided in the internal wall 18 so that the metal contact is depressed below the surface of internal wall 18. Combinations of elevated, flush, and/or depressed contacts may be provided in a connector 12, as may be desired for a particular application.

The connector 12 may be made by molding the plastic shell 14 with the internal cavity 30, the internal cavity defining the internal wall or surface 18 that is accessible through the open end 20. The next step is forming the electrical connector contact 16 by coating a predetermined area 19 of the internal wall or surface 18 with a metal. The connector shell 214 may be molded with a via hole penetrating the internal wall or surface 18, and the conductive via 32 is formed by coating the via hole with a metal adjoining the electrical connector contact 16. The electrical connector contact 16 is formed by metallizing a predetermined area 19 of the internal surface or wall 18. Essentially any method for metallizing or coating plastic may be employed in the practice of the invention, including sputtering, chemical vapor deposition, and immersion plating. Lithography processes may be employed to apply a photoresist pattern to define areas to be metallized. The surface of the plastic to be metallized may be catalyzed to enhance deposition of metal. For example, palladium may be used as a catalyst for gold in an immersion plating process.

Figure 8:
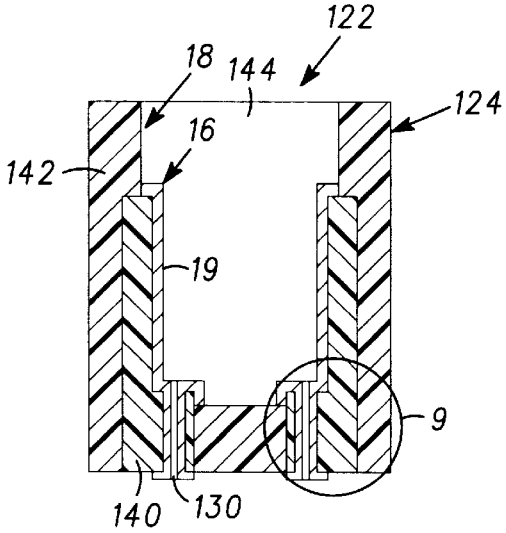
FIG. 8 presents a side cross-sectional view of a connector according to an aspect of the invention having first and second connector shell components and a metal via.

According to a further aspect of the invention, with reference to FIG. 8, a method of making an electrical connector 122 having a "two-shot" molded shell 124 is provided, comprising the steps of molding plastic into a first plastic shell component 140; catalyzing the first plastic shell component 140 with a plating catalyst; molding a second plastic shell component 142 around the first plastic shell component 140 to form the internal surface or wall 18 that is accessible through an open end 144 of the second plastic shell component without covering an area of the first plastic shell component 140 disposed upon the internal wall or surface 18; and, plating the area with a metal to form the electrical connector contact 16. The two-shot molded shell 124 further comprises a metal via 130 that provides access to the contact 16 from outside the shell 124.

Figure 9:
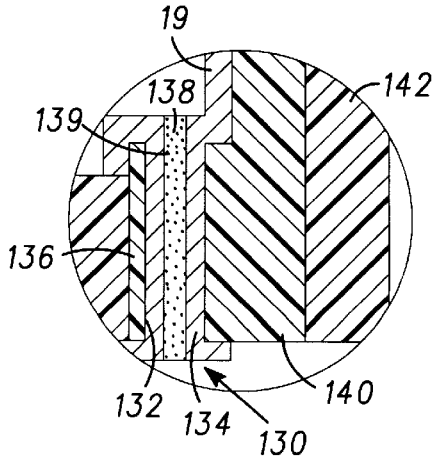
FIG. 9 presents a portion of the FIG. 8 connector showing an enlarged view of an embodiment of the metal via.

Referring now to FIG. 9, an enlarged view of the portion of FIG. 8 indicated as 9 is presented that shows a preferred arrangement for the via 130. The first shell component 140 is provided with a via portion 136 that has a via hole 132. The hole 132 is catalyzed, as described above, and a plated metal layer 134 is deposited therein during the plating process. The plated metal layer 134 is typically quite thin and may leave a residual hole 138 that may be left open, but is preferably sealed or filled with a sealant material 139, such as solder, epoxy compounds, polyurethane compounds, or other suitable materials. Solder is often used since it easily wicks into the residual hole 138 while soldering the metal via 130 to an external wire or a metal trace on a circuit board. Although, described in relation to a two-shot connector shell 124, this method may be implemented to create metal vias with other types of plating processes.

Referring again to FIGS. 2–7, the internal wall 18 may comprise the wall floor 34 configured as an internal plastic surface oriented on a reference plane, with a conductive via 32 disposed therethrough and four tangentially-adjoined plastic walls 35–38 originating at the open end 20 and terminating at the internal plastic surface or wall floor 34. Each of the plurality of electrical connector contacts 16 comprise the metal covered area 19, which extends from at least one of the four tangentially-adjoined plastic walls 35–38 through the conductive via 32. A sealant material may be disposed within the conductive via. The shell 14 may comprise an external opposing plastic surface 40 opposite the internal plastic surface or wall floor 34, and the conductive via 32 and the sealant material may extend between the internal plastic surface 34 and the opposing plastic surface 40. The connector 12 may further comprise an electrical component connected to the sealant material proximate the opposing plastic surface 40.

Referring now to FIGS. 10–20, connectors according to the invention having various electrical connector contact configurations are presented. Though shown having elevated contacts, it is understood that flush contacts and depressed contacts, or combinations thereof, may be employed equally well. Also, the connector shell in each example is presented as a two-shot shell, as previously described in relation to FIG. 8. Once again, it is understood that other connector shell configurations may be employed without departing from the invention.

Figure 10:
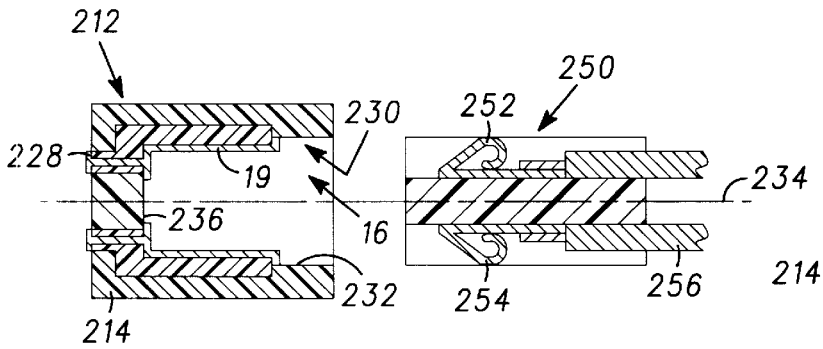
FIG. 10 presents a side cross-sectional view of a disassembled connector assembly according to an aspect of the invention, wherein one connector comprises metallized plastic contacts distributed on two opposing internal walls, and the mating connector comprises metal contacts, the view of the connector being taken along line 10—10 of FIG. 11.
Figure 11:
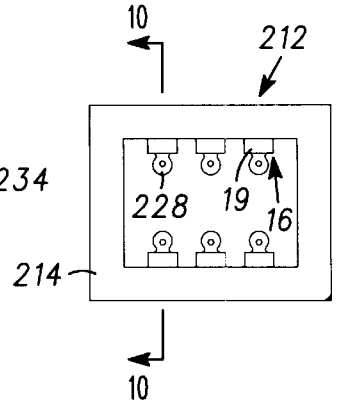
FIG. 11 presents an end view of the FIG. 10 connector (from the same perspective as FIG. 2)

Referring now specifically to FIGS. 10 and 11, a cross-sectional view from the side and an end view, respectively, of a plastic electrical connector 212 are presented for attachment to a matching electrical connector 250 having at least one matching contact 252. The connector 212 comprises a plastic shell 214 having at least one open cavity 230 configured to receive the matching electrical connector 250. In this example, the matching contact 252 comprises a metal leaf spring, and an insulated lead wire 256 soldered to the leaf spring 252. Additional matching contacts 254 may be provided. The metal leaf springs 252 and 254 provide resilience, which is desirable in order to allow clearance between the two connectors to facilitate assembly, and yet maintain electrical contact. The cavity 230 defines an internal wall 232. At least one electrical connector contact 16 according to the invention is positioned to electrically connect with the matching contact 252 upon insertion of the matching electrical connector 250 into the plastic shell 214, and comprises a metal covered area 19 of the internal wall 232. The electrical connector 212 typically comprises a plurality of electrical connector contacts 16. In the embodiment presented, the plastic shell 214 and cavity 230 are elongate in an axial direction 234, and the electrical connector contacts 16 are elongate in the axial direction 234. A metal via 228 is provided in close proximity to and adjoining each contact 16. As presented in FIG. 10, the internal cavity 230 may comprise an internal floor 236, and the metal via 228 extends through the internal floor 236.

Figure 12:
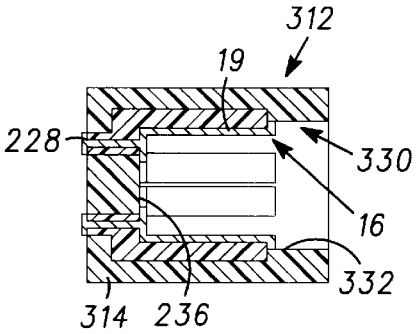
FIG. 12 presents a side cross-sectional view of a connector configuration wherein metallized plastic contacts are distributed around all four internal side walls according to a further aspect of the invention, the view being taken along line 12—12 of FIG. 13.
Figure 13:
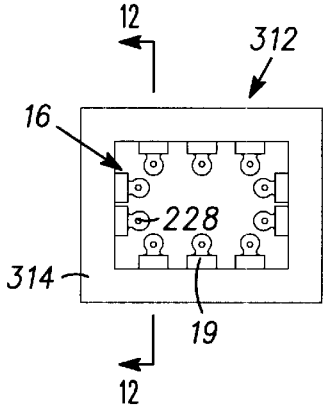
FIG. 13 presents an end view of the FIG. 12 connector (from the same perspective as FIG. 2)

Referring now to FIGS. 12 and 13, similar cross-sectional and end views of a connector 312 are presented. The connector 312 comprises a shell 314 that has an internal cavity 330 that defines an internal wall 332. Several contacts 16 are spaced around the internal wall 332 on all sides. In other respects, the connector 312 is the same as connector 212.

Figure 14:
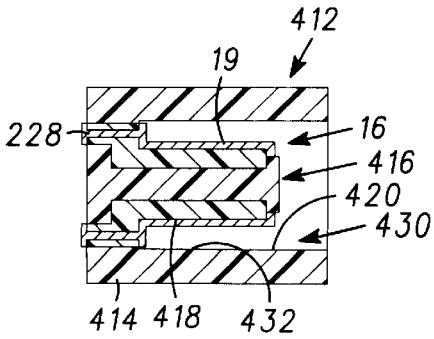
FIG. 14 presents a side cross-sectional view of a connector configuration comprising an island structure with metallized plastic connectors according to a further aspect of the invention, the view being taken along line 14—14 of FIG. 15.
Figure 15:
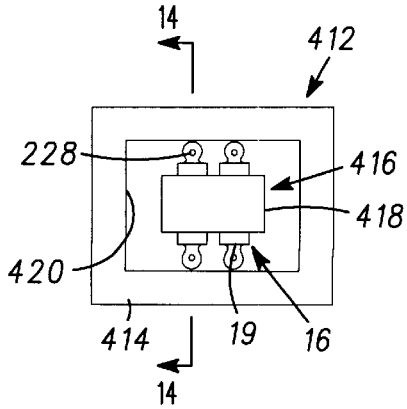
FIG. 15 presents an end view of the FIG. 14 connector (from the same perspective as FIG. 2)

Referring now to FIGS. 14 and 15, similar cross-sectional and end views are presented of a connector 412 having a shell 414 that defines an internal cavity 430 and that comprises an island structure 416 surrounded by the internal cavity 430. The internal cavity 430 defines an internal wall 432. The electrical connector contact 16 is configured as before and comprises a metal covered area 19 of the internal wall 432 positioned on the island structure 416. The island structure 416 may form an island wall 418 facing a surrounding portion 420 of the internal wall, and the electrical connector contact 16 is positioned on the island wall 418.

Figure 16:
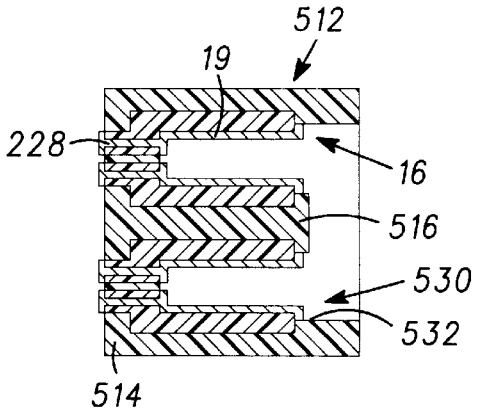
FIG. 16 presents a side cross-sectional view of a connector configuration having a plurality of internal cavities according to a further aspect of the invention, the view being taken along line 16—16 of FIG. 17.
Figure 17:
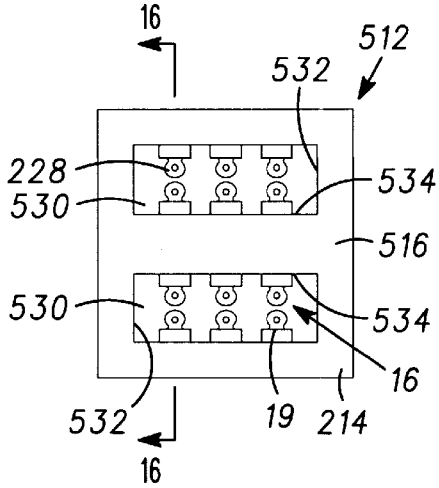
FIG. 17 presents an end view of the FIG. 16 connector (from the same perspective as FIG. 2)

Referring now to FIGS. 16 and 17, similar cross-sectional and end views are presented of a connector 512 that comprises a shell 514. The shell 514 comprises a plurality of internal cavities 530 and a plurality of the electrical connector contacts 16. Each internal cavity 530 defines a corresponding internal wall 532, and a corresponding contact 16 comprising a metal covered area 19 on each corresponding internal wall 532. The two internal cavities 530 are separated by a bridge portion 516 that extends between opposing walls 534 of the internal wall 532.

Figure 18:
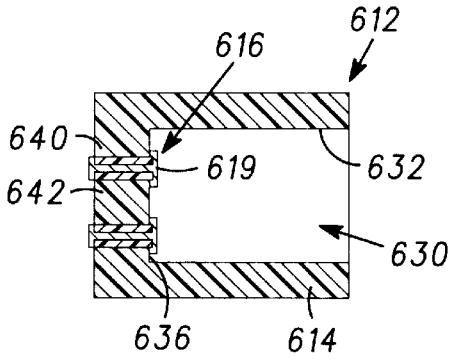
FIG. 18 presents a side cross-sectional view of a connector configuration having an internal cavity that defines and internal floor with metallized plastic contacts according to a further aspect of the invention, the view being taken along line 18—18 of FIG. 19.
Figure 19:
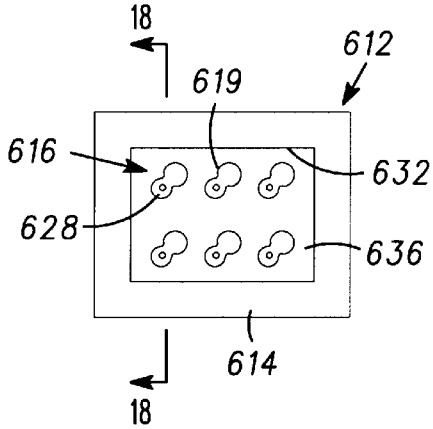
FIG. 19 presents an end view of the FIG. 18 connector (from the same perspective as FIG. 2); and, FIG. 20 presents a cross-sectional side view of a connector having a circuit board is presented according to a further aspect of the invention.

Referring now to FIGS. 18 and 19, similar cross-sectional and end views of a connector 612 are presented having bottom contacts. The connector 612 comprises a plastic shell 614 and at least one electrical connector contact 616. The plastic shell 614 has an internal cavity 630 that defines an internal wall 632, and the internal wall 632 has an internal floor 636. Each contact 616 comprises a metal covered area 619 on the internal floor 636. A metal via 628 is provided that passes through the internal floor 636 to provide access to the contact 616 external to the shell 614. The mating connector (not shown) has spring loaded button contacts, of a type known in the art, and the vias 628 are preferably shifted to one side in order to avoid interference with said button contacts. The shell 614 comprises a first shell component 640 and a second shell component 642.

Figure 20:
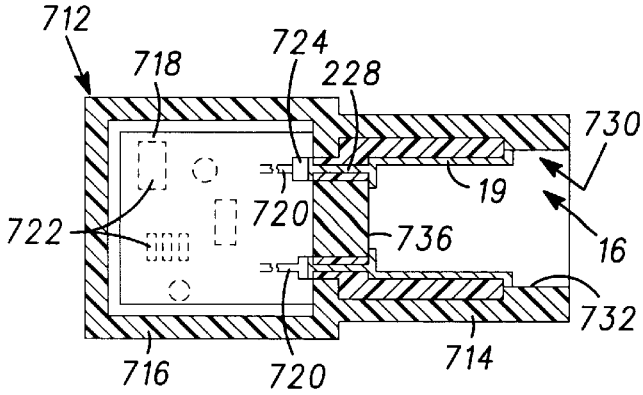

Referring now to FIG. 20, a connector 712 is presented according to a further aspect of the invention. The connector 712 comprises a connector shell 714 that has an internal cavity 730 that defines and internal wall 732 and at least one electrical contact 16. In the example presented, the connector 712 has a plurality of contacts 16. The internal cavity 730 defines an internal wall 732 that has an internal floor 736. The connector 712 also comprises a circuit board shell 716 attached to the shell 714, and a circuit board 718 mounted within the circuit board shell 716. The circuit board shell 716 comprises a cavity that encloses the circuit board 718, and a conductive trace 720 electrically connected to the electrical contact 226 by the metal via 228. Typically, a plurality of such conductive traces 720 are provided adhered to the circuit board, according to practices well known in the art, and each of the conductive vias 228 is electrically connected to a corresponding one of the conductive traces 720 and a corresponding one of the electrical connector contacts 16. The circuit board 718 may be attached to the circuit board shell 716 by methods known in the art for circuit board packaging. Shielding may be provided, as needed. Thus the connector 712 provides connection capability to a mating connector, such as mating connector 250 of FIG. 10, as well as circuit board packaging capability, as presented in FIG. 20. The circuit board 718 may be configured with a variety of electrical components 722 (shown in phantom) that perform a variety of functions known in the art and apparent in light of the description provided herein. One such configuration, for example, is an on-board computer for an automobile. A chip part 724, such as a capacitor, resistor, diode, or other components as may be needed, may be positioned adjacent the metal via 228 and soldered in place to the via 228 and circuit board conductor 720. The chip part 724 positioned in such manner also serves to block any residual hole that may be present in the metal via 228, as previously described in relation to FIG. 9. The connector 712 may be made by molding the connector shell 714, as previously described, with the circuit board housing 716, and mounting the circuit board to said plastic shell within the enclosed cavity defined by the circuit board housing 716, and electrically connecting the electrical connector contact 16 to the conductive trace 720.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. An electrical connector, comprising:

a plastic shell having an open end, an enclosed cavity, and an internal wall separating said plastic shell and said enclosed cavity;

a plurality of electrical connector contacts each being a metal plated area on said internal wall;

a circuit board mounted to said plastic shell within said enclosed cavity, said circuit board comprising a plurality of conductive traces; and, a plurality of conductive vias penetrating said internal wall, each of said conductive vias being metal coated to the vias and electrical connected to a corresponding one of said conductive traces and a corresponding one of said electrical connector contacts.

2. An electrical connector, comprising:

a plastic shell having a plastic surface oriented on a reference plane, said plastic surface having a conductive via disposed therethrough, four tangentially-adjoined plastic walls originating at an open end and terminating at said plastic surface;

a plurality of electrical connector contacts each being a metal plated area on the plastic surface extending from at least one of said four tangentially-adjoined plastic walls through said conductive via.

3. The connector of claim 2, further comprising a sealant material disposed within said conductive via.

* * * * *

UNITED STATES PATENT AND TRADEMARK OFFICE

CERTIFICATE OF CORRECTION

PATENT NO. : 6,375,512 B1
DATED : April 23, 2002
INVENTOR(S) : Zito et al.

It is certified that error appears in the above-identified patent and that said Letters Patent is hereby corrected as shown below:

Column 7,
Line 13, reads "electrical", should be -- electrically --

Signed and Sealed this

Sixteenth Day of July, 2002

*Attest:*

*Attesting Officer*

JAMES E. ROGAN
*Director of the United States Patent and Trademark Office*